US009067405B2

(12) United States Patent
Humele et al.

(10) Patent No.: US 9,067,405 B2
(45) Date of Patent: Jun. 30, 2015

(54) PRINTING DEVICE FOR CONTAINERS

(71) Applicant: KRONES AG, Neutraubling (DE)

(72) Inventors: Heinz Humele, Thalmassing (DE); Roland Ederer, Brennberg (DE); Bernhard Domeier, Hohengebraching (DE)

(73) Assignee: KRONES AG, Neutraubling (DE)

( * ) Notice: Subject to any disclaimer, the term of this patent is extended or adjusted under 35 U.S.C. 154(b) by 57 days.

(21) Appl. No.: 13/653,748

(22) Filed: Oct. 17, 2012

(65) Prior Publication Data

US 2013/0098253 A1 Apr. 25, 2013

(30) Foreign Application Priority Data

Oct. 19, 2011 (DE) ..... 10 2011 084 798

(51) Int. Cl.

| | |
|---|---|
| ***B41F 15/44*** | (2006.01) |
| ***B41F 15/08*** | (2006.01) |
| ***B41F 15/30*** | (2006.01) |
| ***B41F 15/42*** | (2006.01) |

(52) U.S. Cl.

CPC ..... *B41F 15/0872* (2013.01); *B41F 15/30* (2013.01); *B41F 15/423* (2013.01)

(58) Field of Classification Search

CPC ..... B41F 15/0872; B41F 15/0886; B41F 15/089; B41F 15/0895; B41F 15/44; B41F 15/46; B41F 15/0818; B41F 15/42; B41F 15/423; B41F 15/30

USPC ..... 101/35, 36, 38.1, 39, 350.6, 123; 15/117, 245, 250.452, 250.46

See application file for complete search history.

(56) References Cited

U.S. PATENT DOCUMENTS

| | | | | |
|---|---|---|---|---|
| 3,543,680 | A | 12/1970 | Killen et al. | |
| 3,783,777 | A | 1/1974 | Killen et al. | |
| 3,933,091 | A * | 1/1976 | Von Saspe | 101/40 |
| 4,844,769 | A * | 7/1989 | Kronseder | 156/378 |
| 7,987,781 | B2 * | 8/2011 | Doyle et al. | 101/123 |

OTHER PUBLICATIONS

Kamman USA, Inc., SD6000, "UV Bottle Printing in Perfection".

Extended European Search Report for EP12185193.5, issued Feb. 11, 2013.

* cited by examiner

*Primary Examiner* — Daniel J Colilla
*Assistant Examiner* — Quang X Nguyen
(74) *Attorney, Agent, or Firm* — Marshall, Gerstein & Borun LLP

(57) ABSTRACT

A printing device for containers, such as bottles, cans or cups, with a screen to apply a screen print onto the containers, where a squeegee holding device that is guided by a continuous track holds an squeegee in such a way that while the printed image is being applied to the container, one end of the squeegee scrapes across the screen and forces ink through the screen onto one of the containers, and where the distance between the end of the squeegee and the squeegee holding device varies. Also, a container handling device, in the manner of a bottling plant, with such a printing device and a mechanical turret designed to guide the containers to a surface of the container contact device facing away from the squeegee. Also, a method for applying ink to containers in accordance with a screen printing principle.

12 Claims, 1 Drawing Sheet

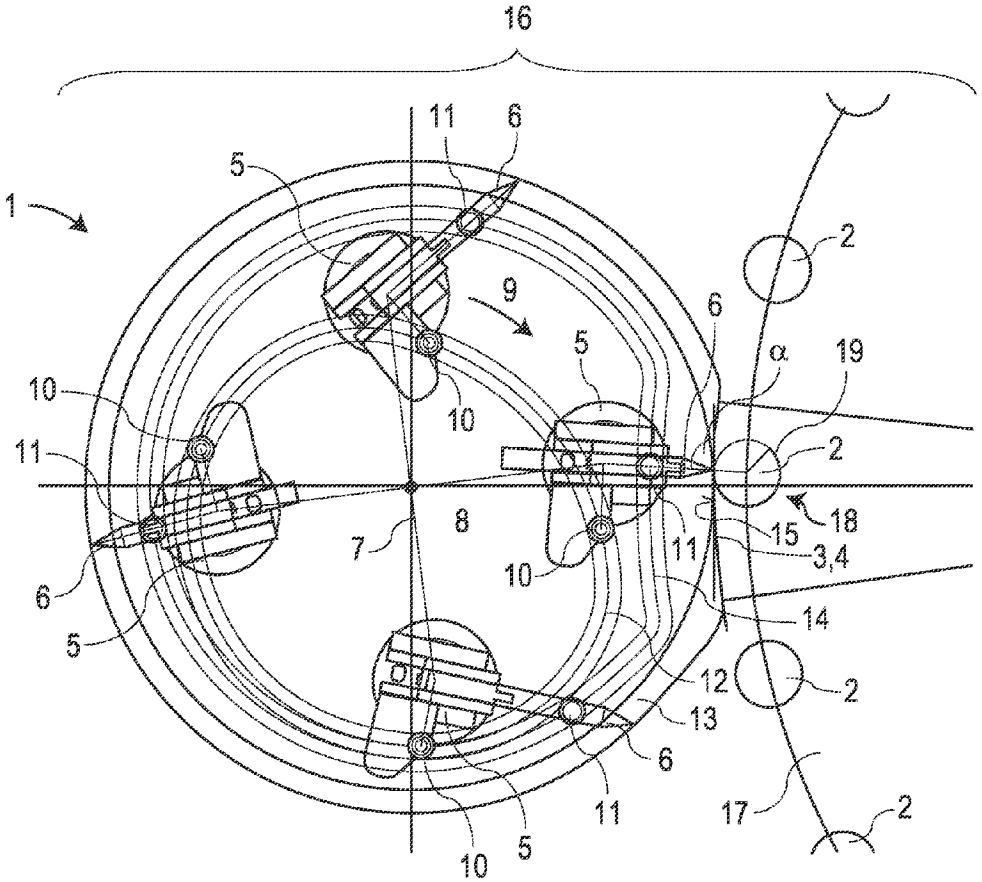
1
2
2
2
2
3,4
5
5
5
5
6
6
6
6
7
8
9
10
10
10
10
11
11
11
11
12
13
14
15
16
17
18
19
α

PRINTING DEVICE FOR CONTAINERS

CROSS-REFERENCE TO RELATED APPLICATION

The present application claims the benefit of priority of German Application No. 102011084798.7, filed Oct. 19, 2011. The entire text of the priority application is incorporated herein by reference in its entirety.

FIELD OF THE DISCLOSURE

The disclosure refers to a printing device for containers, with a screen to apply a screen print onto the container, where a squeegee holder that is guided by a continuous track holds a squeegee in such a way that while the printed image is being applied to the container, one end of the squeegee scrapes across the screen and forces ink through the screen onto the container.

BACKGROUND

A printing device of this type is designed for hollow bodies, specifically for applying ink directly onto container(s), such as bottles, cans or cups.

A device to print on the exterior container surfaces of bottles or containers is for instance known from WO 2009/052890 A1, although an offset print process is disclosed therein. DE 29 46 251 A1 also discloses a printing machine for containers. The printing machine is equipped with a retainer for the object to be printed, consisting of two components that contact the object in regions that are at a distance from each other, where at least one of the retainer components is arranged in a rotating manner and is equipped with a register element that can be brought into an orientation where it functions in conjunction with a register marker applied to the object to be printed, and the register element can rotate relative to the retainer component until the register element and the register marker are engaged, where the object and the retainer component and the register element rotate in the same direction, but at different speeds, until said register element and register marker are engaged.

Devices that employ the screen printing process are for instance known from EP 1 468 827 A1, EP 1 164 010 A1 and EP 0 983 847 A1. A printing device that also employs a screen printing process is furthermore known from US 2003/0121428 A1, where rotating squeegees are employed.

There are also already a large number of machines in use, for instance from Kammann USA, Inc., which sells the SD 6000 system. However, that system uses an oscillating squeegee that travels parallel to the container while forcing UV curing ink onto the container through a screen. This system has the disadvantage that a retract stroke is necessary for the squeegee.

SUMMARY OF THE DISCLOSURE

One aspect of the present disclosure is to provide a more cost effective and simplified printing device, specifically one that does not require a retract stroke. The retract stroke of the squeegee is to be avoided.

This aspect is provided according to the present disclosure by the fact that the distance between the end of the squeegee and the squeegee-holder is variable. An squeegee-holder can also be designated as an squeegee holding device. On the one hand a predefined angle of attack can be maintained during the printing process, while also employing simple drive mechanisms to avoid an idle stroke for the squeegee-holder that occurs during oscillating motions. This results in a cost-effective system with high throughput.

Using this approach, uniform squeegee pressure can be applied onto the screen in the contact area of the squeegee with the screen, which can also be designated as a container contact device, and also permits sufficient and precisely dosed ink to be forced through the screen. The functionality is improved. The length of the squeegee varies depending on the position of the squeegee-holder on the continuous track.

It is advantageous if the squeegee is guided along the screen in such a manner that the squeegee's angle of attack remains constant along the entire surface of the screen. Contact of the squeegee with the screen as the squeegee moves across the surface of the screen is then assured across the entire length.

It is also advantageous if the continuous track is configured as a curved track, in the manner of a circular track, or track that is composed of several polygon-shaped sections, around an axis of rotation, and preferably has a section that runs nearly parallel to the surface of the screen that faces the squeegee. Simple kinematics can be employed with such an advantageous configuration. The continuous track can be shaped as a correspondingly curved rail. The continuous track now performs the function of a cam.

In order to attain a high quality printed image on the container, it is advantageous if the container contact device is formed by a preferably textile-like screen, such as a weave or a mesh, which is permeable to fluids at least in sections. Moreover, it is advantageous if the squeegee is supported in the squeegee-holder in such a way that a projection of the squeegee beyond the squeegee-holder varies dimensionally depending on the position of the squeegee-holder on the continuous track.

Supplying the screen surface that faces the squeegee with fluid, such as ink or paint, is particularly easy if the squeegee-holder is movable around the axis of rotation of a rotating distributor, preferably by means of a palette rotor. Any potential ink supply line can then be implemented using a centrally located rotating distributor.

When the rotating distributor is equipped with several arms, preferably four arms, with an squeegee-holder being connected in a jointed manner to the end of each arm, the squeegee-holders connected in a hinged manner relative to the rotating distributor can perform a circumferential motion of the squeegee. A squeegee guide in the manner of a palette conveyor can then be implemented to avoid the retract stroke of the squeegee. It is also advantageous if the continuous track is configured in such a way that the angle between the squeegee and the respective arm that leads to the respective squeegee-holder varies as the squeegee-holder rotates around a center of rotation. While the squeegee-holder is always at a constant distance around the rotational center during the circular rotation, the distance between a center point of the squeegee-holder and the rotational center of the rotating distributor can then remain constant in any angular orientation.

Yet another advantageous example of an embodiment is that the squeegee-holder is attached to a first coupling location on a first specified curved track, where the squeegee-holder can move along the first specified curved track, and the squeegee-holder is connected to a second coupling location on a second curved track that encompasses the first curved track, where the squeegee-holder can move along the second curved track. The precise position of the squeegee, specifically relative to the screen, can then be predetermined by means of such guiding cams provided by the first and second curved tracks. Linear motors can be employed alternatively or additionally.

The disclosure also refers to a container handling device, such as in the manner of a bottling plant, with a printing device of the type presented herein and a mechanical turret designed to guide containers to a surface of the screen facing away from the squeegee.

It is further advantageous when the mechanical turret is designed to rotate the container around its length axis while the container is in contact with the screen. The container, such as a bottle, can then be advantageously rolled off the screen while the squeegee ink or paint is forced through the screen onto the bottle surface. This then permits the attainment of particularly high quality.

It is also advantageous if the mechanical turret is designed to accommodate a large number of containers, since this increases the throughput of containers per unit of time.

The disclosure also refers to a method of applying fluid, such an ink or paint, onto a container surface by employing the screen printing process.

BRIEF DESCRIPTION OF THE DRAWING

A first embodiment of the disclosure is explained in greater detail as follows, also with the aid of the drawing. The only figure shows a schematic view from above onto a printing device, which is used together with a mechanical turret in a container handling device according to the disclosure.

The drawing is strictly of a schematic nature and only serves to convey the operating principles of the disclosure.

DETAILED DESCRIPTION OF THE PREFERRED EMBODIMENT

The figure represents a printing device 1 according to the present disclosure. The printing device 1 is designed to apply a fluid, such as ink or paint, onto containers 2 guided onto said printing device. Containers 2 can be configured as hollow shapes, in particular as bottles, cans, or cups. The printing device employs the screen printing principle.

The printing device 1 is equipped with a container contact device 3. The container contact device 3 is configured as a screen 4 and has mesh—not shown—through which ink can be forced. To force the ink through the screen, squeegees 6, which are attached to several squeegee-holders 5, are employed. For instance, four squeegee-holders 5 are employed that are distributed around a rotating point at a constant angle.

The squeegee-holders 5 are moved by a rotating distributor 7 around an axis of rotation 8 of the rotating distributor 7 along a circular track in the direction of arrow 9. The squeegee-holders 5 are connected to the arms of the rotating distributor 7 in a jointed manner.

The squeegee-holder 5 is equipped with a first coupling location 10 and a second coupling location 11. The coupling locations 10 and 11 are configured as cam rollers.

The first coupling location 10 is guided along a first curved track 12 and the second coupling location 11 is guided along a second curved track 13. The second curved track 13 encompasses the first curved track 12.

Whereas the first curved track 12 is primarily oval in shape, the second curved track 13 has a nearly linear section 14, which primarily follows the alignment of the container contact device 3, that is to say the screen 4. The linear section 14 travels completely, or nearly, parallel to a plane through a surface 15 of the screen 4 facing the squeegee 6.

The printing device 1 is part of a container handling device 16 and is also equipped with a mechanical turret 17. The mechanical turret 17 is configured to accommodate a large number of containers 2, and is designed in such a way that the containers 2 are set in rotation in the direction of arrow 18 during contact with the screen 4. A layer 19 of ink or paint is then applied directly onto the container 2. However, it is also possible that a label is located between the container surface of the container 2 and the layer 19.

A process according to the disclosure guides the containers 2 through the mechanical turret 17 to the screen 4 in such a way and moves the squeegee-holder 5 with the squeegees 6 in such a way that a layer 19 is applied to the surface of the containers 2. Subsequent downstream stations, such as radiation drying or curing stations, are not shown, but conceivable.

An angle of attack is labeled with the reference label a in the figure and is nearly 90° in the specific position shown. In order to achieve a uniformly printed image, the angle of attack remains nearly constant during the entire process of scraping the squeegee 6 along the surface facing the squeegee 6 of the container contact device 3, that is to say the screen 4. The variation is in the range of ±2°, or even more advantageously in the range of ±1°.

However, the distance of one end of the squeegee 6 to the squeegee-holder 5 varies. A projection of the squeegee 6 out of the squeegee-holder is reduced during the process of scraping along the surface of screen 4 up to a certain central region of the screen 4 and then increases again until the squeegee 6 is once again lifted off the screen 4. During this process, the angle that is formed between the squeegee 6 and the arm of the rotating distributor 7 holding the squeegee-holder 5 changes constantly.

The invention claimed is:

1. A printing device for containers, comprising a screen to apply a screen print onto the containers, a squeegee-holder that is guided by a continuous track and holding a squeegee in such a way that during the container printing process one end of the squeegee scrapes across the screen, thus forcing ink through the screen and onto one of the containers, and the distance between the end of the squeegee and the squeegee-holder is variable, wherein the squeegee-holder is connected to a first coupling location on a first curved track in a manner allowing the squeegee-holder to travel along the first curved track, and also connected to a second coupling location on a second curved track that encompasses the first curved track, in a manner allowing the squeegee-holder to travel along the second curved track, wherein the first and the second curved tracks predetermine the position of the squeegee, wherein the squeegee-holder is movable around an axis of rotation of a rotating distributor, and wherein the rotating distributor is equipped with several arms, and the first curved track and the second curved track are configured in such a way that the angle between the squeegee and the respective arm leads to the respective squeegee-holder changes during the rotation of the squeegee-holder around a center of rotation.

2. The printing device in accordance with claim 1, wherein the squeegee is guided along the screen in such a way that an angle of attack (a) of the squeegee remains nearly constant during the movement along the entire surface of the screen.

3. The printing device in accordance with claim 2, wherein the angle of attack ($\alpha$) is in the range of one of ±2° and ±1°.

4. The printing device in accordance with claim 1, wherein the continuous track is configured as a curved track in the manner of one of a circular track and a track composed of several polygon shaped sections, around an axis of rotation.

5. The printing device in accordance with claim 4, wherein the continuous track is equipped with a section that runs nearly parallel to the surface of the screen facing the squeegee.

6. The printing device in accordance with claim 1, wherein the squeegee is supported in the squeegee-holder in such a way that a projection of the squeegee beyond the squeegee-holder varies dimensionally depending on the position of the squeegee-holder on the continuous track.

7. The printing device in accordance with claim 1, wherein the squeegee-holder is connected in a hinged manner to the end of each said arm of the rotating distributor.

8. The printing device in accordance with claim 7, wherein the rotating distributor is equipped with four arms.

9. The printing device in accordance with claim 1, wherein the containers are one of bottles, cans, and cups.

10. The printing device in accordance with claim 1, wherein the squeegee-holder is movable by means of a palette rotor.

11. A printing device for containers, comprising a screen to apply a screen print onto the containers, a squeegee-holder that is guided by a continuous track and holding a squeegee in such a way that during the container printing process one end of the squeegee scrapes across the screen, thus forcing ink through the screen and onto one of the containers, and the distance between the end of the squeegee and the squeegee-holder is variable, wherein the squeegee-holder is connected to a first coupling location on a first curved track in a manner allowing the squeegee-holder to travel along the first curved track, and also connected to a second coupling location on a second curved track that encompasses the first curved track, in a manner allowing the squeegee-holder to travel along the second curved track, wherein the first and the second curved track predetermine the position of the squeegee, wherein the first curved track is primarily oval in shape and the second curved track has a nearly linear section, which primarily follows the alignment of the screen.

12. A printing device for containers, comprising a screen to apply a screen print onto the containers, a squeegee-holder that is guided by a continuous track and holding a squeegee in such a way that during the container printing process one end of the squeegee scrapes across the screen, thus forcing ink through the screen and onto one of the containers, and the distance between the end of the squeegee and the squeegee-holder is variable, wherein the squeegee-holder is connected to a first coupling location on a first curved track in a manner allowing the squeegee-holder to travel along the first curved track, and also connected to a second coupling location on a second curved track that encompasses the first curved track, in a manner allowing the squeegee-holder to travel along the second curved track, wherein the first and the second curved track predetermine the position of the squeegee, wherein the first curved track and the second curved track are non-parallel with respect to each other in a section where the squeegee scrapes across the screen.

* * * * *